US006541437B2

(12) United States Patent
Mendez Mata et al.

(10) Patent No.: US 6,541,437 B2
(45) Date of Patent: Apr. 1, 2003

(54) SPECKLED DETERGENT COMPOSITION

(75) Inventors: Lucia Mendez Mata, Estado de Mexico; Fabrizio Meli, Mexico City, both of (MX)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/813,253

(22) Filed: Mar. 20, 2001

(65) Prior Publication Data

US 2001/0053757 A1 Dec. 20, 2001

Related U.S. Application Data

(60) Provisional application No. 60/194,844, filed on Apr. 5, 2000.

(51) Int. Cl.[7] ..... C11D 3/06; C11D 3/14; C11D 7/02

(52) U.S. Cl. ..... 510/348; 510/349; 510/438; 510/510

(58) Field of Search ..... 510/348, 349, 510/438, 510

(56) References Cited

U.S. PATENT DOCUMENTS

| | | | | |
|---|---|---|---|---|
| 4,097,418 | A | 6/1978 | Rolfes | |
| 4,101,455 | A | 7/1978 | Francis et al. | |
| 4,113,644 | A | 9/1978 | Ashcraft | |
| 4,240,920 | A | 12/1980 | De Lugue | |
| 4,379,080 | A | 4/1983 | Murphy | |
| 4,417,994 | A | 11/1983 | Stoddart | |
| 4,434,068 | A | 2/1984 | Delwel et al. | |
| 4,721,633 | A | 1/1988 | Baldassin | |
| 4,925,586 | A | 5/1990 | Baker et al. | |
| 6,281,187 | B1 * | 8/2001 | Smerznak | 510/418 |

FOREIGN PATENT DOCUMENTS

| | | |
|---|---|---|
| EP | 0 057 088 A1 | 8/1982 |
| NL | 6911825 | 8/1969 |
| WO | WO 97/11151 | 3/1997 |

* cited by examiner

*Primary Examiner*—Gregory Delcotto
(74) *Attorney, Agent, or Firm*—Marianne Dressman; Julia A. Glazer; Kim William Zerby

(57) ABSTRACT

Speckled detergent compositions with colored glassy phosphates and conventional detergent ingredients.

9 Claims, No Drawings

SPECKLED DETERGENT COMPOSITION

CROSS REFERENCE TO RELATED APPLICATIONS

This application claims priority under 37 U.S.C. §119(e) to U. S. Provisional Application Ser. No. 60/194,844, filed Apr. 5, 2000.

FIELD OF THE INVENTION

The present invention relates to speckled detergent compositions comprising colored glassy phosphates. The colored glassy phosphates impart improved aesthetic appeal as well as functionality to granular detergent compositions.

BACKGROUND OF THE INVENTION

The commercial marketing of laundry detergent products often involves the use of distinctive product aesthetics to help consumers differentiate one given product from other commercially available products of the same general type. Colored, e.g., dyed or pigmented, speckles are sometimes used to create such distinctiveness. Colored speckles known in the art are generally opaque.

Various methods of making granular colored speckles are known in the art. For example, U.S. Pat. No. 4,097,418 issued Jun. 27, 1978, to The Procter & Gamble Co. describes an agglomeration process wherein an inorganic alkaline salt is agglomerated with an anionic surfactant paste which serves as an adhesive agent containing a coloring agent, to provide the speckled detergent composition. Another method is to merely mix two differently colored spray dried granular compositions in the desired proportions.

Accordingly the need remains for a colored speckle that is easily and inexpensively produced and provides for superior consumer recognition of the product in which it is included. Additionally, there is a need for a colored speckle that offers aesthetic appeal while also improving the cleaning power of the detergent composition in which it is included.

SUMMARY OF THE INVENTION

By the present invention it has now been discovered that glassy phosphates can be used to make transparent speckles with very distinct visual characteristics in comparison to traditional opaque speckles. Additionally, it has been discovered that the appearance of the speckles can be further enhanced by coating them with sparkled materials, resulting in more visible and distinct speckles. Speckles made from glassy phosphates also provide significantly improved builder capability than sodium carbonate builders. Sodium carbonate builders have the drawback of precipitating calcium carbonate which can build up on fabric. In contrast, glassy phosphate builders exert a powerful sequestering and suspending effect and tend to hydrolyze or revert in aqueous solution and heat to pyrophosphates and orthophosphates.

The present invention meets the aforementioned needs by providing a speckled detergent composition comprising from about 0.01% to about 8.0% by weight of the total composition, of colored glassy phosphate speckles, preferably from about 0.1% to about 5.0% by weight of the total composition, most preferably from about 0.5% to about 3.5% by weight of the total composition and from about 92.0% to about 99.99%, preferably from about 95.0% to about 99.9%, and most preferably from about 96.5% to about 99.50% of conventional laundry ingredients selected from the group consisting of surfactants, builders, chelants, brighteners, bleaching ingredients, photobleaches, enzymes, soil release polymers, dye transfer inhibitors, fabric integrity polymers, fillers, perfumes and mixtures thereof.

It has also been discovered that using functional dyes to color glassy phosphates provides a dual benefit. First an aesthetic benefit is achieved by providing translucent color to the speckles and second, a functional benefit is achieved by improving the cleaning performance of the detergent composition the particles are added to.

All percentages, ratios, and proportions herein are on a weight basis unless otherwise indicated. All documents cited are hereby incorporated by reference in their entirety.

DETAILED DESCRIPTION OF THE INVENTION

The present invention provides speckled granular detergent compositions useful in hand and machine clothes washing operations which provide an especially desirable aesthetic appeal as well as delivering superior cleaning. Detergent compositions according to the present invention comprise from about 92.0% to about 99.99%, preferably from about 95.0% to about 99.9%, and most preferably from about 96.5% to about 99.50% of conventional laundry ingredients selected from the group consisting of surfactants, builders, chelants, brighteners, bleaching ingredients, photobleaches, enzymes, soil release polymers, dye transfer inhibitors, fillers, perfumes and mixtures thereof and from about 0.01% to about 8.0% by weight of the total composition, of colored glassy phosphate speckles, preferably from about 0.1% to about 5.0% by weight of the total composition, most preferably from about 0.5% to about 3.5% by weight of the total composition.

The present invention also provides the detergent formulator the option of either significantly reducing the amount of detergent builder added to the detergent composition, while maintaining the detergent's performance or alternatively keeping the same level of builder while adding the glassy phosphate speckles and significantly improving the cleaning performance of the detergent.

Colored Speckles

The colored speckles described herein are comprised of glassy phosphates and a dye and/or pigment. Glassy phosphates useful in the present invention are represented by the formula $M_2O:P_2O_5$, wherein M is an alkali metal, preferably sodium or potassium, and the molar ratio between both oxides is from about 0.7:1 to about 1.3:1. The preferred glassy phosphates are those having about 21 phosphorous atoms, in the molecule. However, also suitable are glassy phosphates of shorter chain lengths such as 6 and 13 phosphorous atoms. Also useful are larger glassy phosphates such as sodium acid metaphosphate. Sodium glassy phosphates of other alkali metals such as potassium can also be used to produce colored glassy speckles. Glassy phosphates provide speckles that are transparent rather than opaque like those previously known in the art. By transparent is meant that light travels through the speckles undisturbed. The glassy phosphates useful in the present invention are described in U.S. Pat. No. 2,568,110 to Irving Beiley et al, Sep. 18, 1951, (herein incorporated by reference) and in General and Inorganic Chemistry, J. R. Partington, 4th Ed., MacMillan, 1967, (herein incorporated by reference).

Glassy phosphates are commercially available as dry powders, fine granules, plates, and coarse granules. For example, Sodaphos, Hexaphos®, Glass H® and Sodium Acid Metaphosphate® are brands of glassy phosphates manufactured by FMC Corporation, these phosphates respectively having an approximate chain length of 6, 13, 21 and greater than 21 phosphorus atoms. Glass H® is the preferred material in this range of glassy phosphates. Polyphosphates which have the empirical formulae $Na_{16}P_{14}O_{43}$ and $Na_{12}P_{10}O_{31}$ are sold by the Hooker Chemical Corporation, Niagara Falls, New York and are also suitable.

Due to the building and dispersing properties of glassy phosphates it is possible to reduce the level of phosphate builder in a product containing glassy phosphate speckles, without reducing the performance of the detergent. Alternatively, if the phosphate builder of a detergent composition is not reduced, the glassy phosphates provide additional building and dispersing capacity resulting in superior performance.

The speckles may also optionally contain a commercial sparkling material such as Timiron Dazzle MP-161 available from Rona EM Industrial Chemicals, to provide additional aesthetic benefits.

Generally speckles in detergent products should be in the range of from 200 to 3000 microns, preferably 300 to 1500 microns in size which is equal to or larger than the detergent base granule size. This ensures easy visibility of the speckles by the consumer.

Dyes

Glassy phosphates are colored with conventional dyes and/or pigments as well as functional dyes which provide a second function in addition to providing color to the speckle. Functional dyes suitable for use in the present invention include photo-bleaches such as metal phthalocyanines, and complexes of photo-bleaches such as zinc phtalocyanine and aluminum phtalocyanine. However, other types of dyes such as polymeric colorants (i.e. Liquitint, available commercially from Milliken Chemical) and other hydrophilic dyes are suitable for use in the present invention. Additionally, adsorption of pigments, such as titanium dioxide coated with mica, onto the particles will result in shiny speckles. The amount of dye or pigment adsorbed onto the glassy phosphate particles is from about 0.1% to about 2.0% by weight of the glassy phosphate content, preferably from about 0.05% to about 1.0% by weight of the glassy phosphate content, and most preferably from about 0.1% to about 0.5% by weight of the glassy phosphate content. The most preferable dyes for use in the present invention are the photobleaches such as metal phthalocyanines, and complexes of them, for example, zinc phtalocyanine and aluminum phtalocyanine. These types of dyes are activated by visible light providing bleaching performance on hydrophilic substrates, as well as a distinctive hue on white fabrics, in addition to providing a translucent colored speckle.

Process

The glassy phosphate particles are dyed by the adsorption of a hydrophilic dye (i.e. metal phthalocyanines or complex of them), polymeric colorants or/and pigments, onto the glassy phosphate surface. This process is more advantageous than conventional absorption or blending of the dyes/pigments with the glassy phosphates because it involves a less complicated process and provides a transparent rather than opaque speckle. Traditional blending methods reduce the transparency of the speckle due to hydrolysis of the phosphates into shorter species which form crystals in the speckle.

The adsorption process can be carried out several different ways. One such method uses a blend of water and a non-polar solvent as the carrier of the dye and/or pigment. The glassy phosphates are dried by evaporation of the non-polar solvent at a temperature between 25° C.–100° C., preferably between 40° C.–80° C. and most preferably between 50° C.–60° C.

The ratio of the water and non-polar solvent blend is from 99%:1% to 10%:1% by weight of the total blend, preferably from 50%:1% and more preferably from 40%:1% by weight of the total composition. The non-polar solvent must be miscible in water in these ratios.

Another method to carry out adsorption of the dyes and/or pigments is the atomization of the dyes and/or pigments onto the glassy phosphate particles. This process is carried out in a fluid bed where the inlet air is from about 90° C. to about 110° C., preferably from about 100° C. to about 105° C. The pressure and speed of atomization and the air volume must be adjusted according to the desired dye and/or pigment concentration on the particle. The drying time of the speckles should be minimized to avoid unnecessary overheating.

The colored glassy phosphate speckles described herein are incorporated into detergent compositions by various methods including but not limited to dry admixing.

Optional Detersive Ingredients

As a preferred embodiment, the conventional detergent ingredients are selected from typical detergent composition components such as detersive surfactants and detersive builders. Optionally, the detergent ingredients can include one or more other detersive adjuncts or other materials for assisting or enhancing cleaning performance, treatment of the substrate to be cleaned, or to modify the aesthetics of the detergent composition. Usual detersive adjuncts of detergent compositions include the ingredients set forth in U.S. Pat. No. 3,936,537, Baskerville et al. and in Great Britain Patent Application No. 9705617.0, Trinh et al., published Sep. 24, 1997. Such adjuncts are included in detergent compositions at their conventional art-established levels of use, generally from 0% to about 80% of the detergent ingredients, preferably from about 0.5% to about 20% and can include color speckles, suds boosters, suds suppressors, antitarnish and/or anticorrosion agents, soil-suspending agents, soil release agents, dyes, fillers, optical brighteners, germicides, alkalinity sources, hydrotropes, antioxidants, enzymes, enzyme stabilizing agents, solvents, solubilizing agents, chelating agents, clay soil removal/anti-redeposition agents, polymeric dispersing agents, processing aids, fabric softening components, static control agents, bleaching agents, bleaching activators, bleach stabilizers, etc.

Surfactants

The hand and/or machine washing detergent compositions of the present invention may optionally comprise a non mid-chain branched alkyl sulfate or non-mid chain branched aryl sulphonate surfactant. Depending upon the embodiment of the present invention one or more categories of surfactants may be chosen by the formulator. Preferred categories of surfactants are selected from the group consisting of anionic, cationic, nonionic, zwitterionic, ampholytic surfactants, and mixtures thereof. Within each category of surfactant, more than one type of surfactant of surfactant can be selected. For example, preferably the solid (i.e. granular) and viscous semi-solid (i.e. gelatinous, pastes, etc.) systems of the present invention, surfactant is preferably present to the extent of from about 0.1% to 60%, preferably to about 30% by weight of the composition.

Nonlimiting examples of surfactants useful herein include:

a) $C_{11}$–$C_{18}$ alkyl benzene sulfonates (LAS);

b) $C_{10}$–$C_{20}$ primary, branched-chain and random alkyl sulfates (AS);

c) $C_{10}$–$C_{18}$ secondary (2,3) alkyl sulfates having the formula:

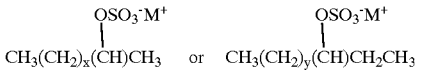

wherein x and (y+1) are integers of at least about 7, preferably at least about 9; said surfactants disclosed in U.S. Pat. No. 3,234,258 Morris, issued Feb. 8, 1966; U.S. Pat. No. 5,075,041 Lutz, issued Dec. 24, 1991; U.S. Pat. No. 5,349,101 Lutz et al., issued Sep. 20, 1994; and U.S. Pat. No. 5,389,277 Prieto, issued Feb. 14, 1995 each incorporated herein by reference;

d) $C_{10}$–$C_{18}$ alkyl alkoxy sulfates ($AE_xS$) wherein preferably x is from 1–7;

e) $C_{10}$–$C_{18}$ alkyl alkoxy carboxylates preferably comprising 1–5 ethoxy units;

f) $C_{12}$–$C_{18}$ alkyl ethoxylates, $C_6$–$C_{12}$ alkyl phenol alkoxylates wherein the alkoxylate units are a mixture of ethyleneoxy and propyleneoxy units, $C_{12}$–$C_{18}$ alcohol and $C_6$–$C_{12}$ alkyl phenol condensates with ethylene oxide/propylene oxide block polymers inter alia Pluronic® ex BASF which are disclosed in U.S. Pat. No. 3,929,678 Laughlin et al., issued Dec. 30, 1975, incorporated herein by reference;

g) Alkylpolysaccharides as disclosed in U.S. Pat. No. 4,565,647 Llenado, issued Jan. 26, 1986, incorporated herein by reference;

h) Polyhydroxy fatty acid amides having the formula:

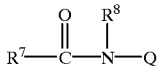

wherein $R^7$ is $C_5$–$C_{31}$ alkyl; $R^8$ is selected from the group consisting of hydrogen, $C_1$–$C_4$ alkyl, $C_1$–$C_4$ hydroxyalkyl, Q is a polyhydroxyalkyl moiety having a linear alkyl chain with at least 3 hydroxyls directly connected to the chain, or an alkoxylated derivative thereof; preferred alkoxy is ethoxy or propoxy, and mixtures thereof; preferred Q is derived from a reducing sugar in a reductive amination reaction, more preferably Q is a glycityl moiety; Q is more preferably selected from the group consisting of —$CH_2(CHOH)_nCH_2OH$, —$CH(CH_2OH)(CHOH)_{n-1}CH_2OH$, —$CH_2(CHOH)_2$—(CHOR')(CHOH)$CH_2OH$, and alkoxylated derivatives thereof, wherein n is an integer from 3 to 5, inclusive, and R' is hydrogen or a cyclic or aliphatic monosaccharide, which are described in U.S. Pat. No. 5,489,393 Connor et al., issued Feb. 6, 1996; and U.S. Pat. No. 5,45,982 Murch et al., issued Oct. 3, 1995, both incorporated herein by reference.

Additionally, the surfactant may be a midchain branched alkyl sulfate, midchain branched alkyl alkoxylate, or midchain branched alkyl alkoxylate sulfate. These surfactants are further described in No. 60/061,971, Oct. 14, 1997, No. 60/061,975, Oct. 14, 1997, No. 60/062,086, Oct. 14, 1997, No. 60/061,916, Oct. 14, 1997, No. 60/061,970, Oct. 14, 1997, No. 60/062,407, Oct. 14, 1997. Other suitable midchain branched surfactants can be found in U.S. Patent applications Ser. Nos. 60/032,035, 60/031,845, 60/031,916, 60/031,917, 60/031,761, 60/031,762 and 60/031,844. Mixtures of these branched surfactants with conventional linear surfactants are also suitable for use in the present compositions.

Detergency Builders

The handwashing detergent composition may also include a detergent builder to assist in controlling mineral hardness and to enhance the removal of particulate soils. Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locations. Importantly, the compositions herein function surprisingly well even in the presence of the socalled "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the NaSKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crisping agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, apreferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted armionium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Adjunct Ingredients

The compositions herein can optionally include one or more other detergent adjunct materials or other materials for assisting or enhancing cleaning performance, treatment of the substrate to be cleaned, or to modify the aesthetics of the detergent composition (e.g., perfumes, colorants, dyes, etc.). The following are illustrative examples of such adjunct materials.

Enzymes—Enzymes can be included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzyme Stabilizers—The enzymes employed herein are stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. Pat. No. 4,537,706.

Bleaching Compounds—Bleaching Agents and Bleach Activators—The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator. Mixtures of bleaching agents can also be used.

Polymeric Soil Release Agent—Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

Chelating Agents—The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Clay Soil Removal/Anti-redeposition Agents—The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylates amines; liquid detergent compositions typically contain about 0.01% to about 5%.

Polymeric Dispersing Agents—Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Brightener—Any optical brighteners or other brightening or whitening agents known in the art can be incorporated at levels typically from about 0.05% to about 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Pluorescent Brightening Agents", M. Zahradnik, Published by John Wiley & Sons, New York (1982).

Dye Transfer Inhibiting Agents—The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

Other Ingredients—A wide variety of other ingredients useful in detergent compositions can be included in the compositions herein, including other active ingredients, carriers, hydrotropes, processing aids, dyes or pigments, solvents for liquid formulations, solid fillers for bar compositions, etc. If desired, soluble magnesium salts such as $MgCl_2$, $MgSO_4$, and the like, can be added at levels of, typically, 0.1%–2%, to provide additional suds and to enhance grease removal performance.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

The colored speckles described herein are suitable for use in non-aqueous, liquid detergent compositions containing non-aqueous solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5% to 90%, typically 10% to 50% of such carriers.

The detergent compositions herein will preferably be formulated such that, during use in aqueous cleaning operations, the wash water will have a pH of from about 6.5 to about 11, preferably from about 8.5 to about 10.7. Techniques for controlling pH at recommended usage levels include the use of buffers, alkalis, acids, etc., and are well known to those skilled in the art.

Detergent Compositions

In order to make the present invention more readily understood, reference is made to the following examples, which are intended to be illustrative only and not intended to be limiting in scope.

EXAMPLES

Examples 1–7: Granular Detergents

| Components | 1 | 2 | 3 | 4 | 5 | 6 | 7 |
|---|---|---|---|---|---|---|---|
| LAS | 21.6 | 18 | 25 | 5 | 0 | 18 | 22 |
| AES | 1.0 | 1.5 | — | — | — | 1.0 | — |
| ADHQ | 0.7 | 0.6 | — | — | — | 0.6 | — |
| AE | — | 0.4 | 0.5 | — | — | — | 0.9 |
| Phosphate | 22 | 13 | 21 | 2 | — | 22 | 21 |
| Silicate | 7.5 | 7.5 | 10 | — | — | 7.5 | 3.5 |
| Carbonate | 13 | 9 | 10 | 80 | 70 | 13 | 4.5 |
| Zeolite | — | 1.5 | — | — | — | — | — |
| DTPA | 0.9 | 0.9 | — | — | — | 0.9 | — |
| SOKALAN ® | 1.0 | 0.9 | — | — | — | 1.0 | — |
| PEI 1800 $E_7$ | — | — | — | — | — | — | — |
| CMC | 0.6 | 0.35 | — | — | — | 0.60 | 0.25 |

-continued

| Components | 1 | 2 | 3 | 4 | 5 | 6 | 7 |
|---|---|---|---|---|---|---|---|
| SRA-1 | 0.2 | 0.2 | — | — | — | 0.2 | — |
| Protease/amylase | 0.36 | 0.54 | 0.3 | — | — | 0.36 | 0.5 |
| Cellulase | 007 | 0.07 | — | — | — | 0.07 | 0.1 |
| Lipase | — | — | 0.05 | — | — | — | — |
| Perborate | 4.10 | 1.35 | — | 4.0 | — | 2.25 | — |
| NOBS | 1.70 | 1.15 | — | — | — | 1.90 | — |
| TAED | 0.6 | — | — | — | — | 0 | — |
| ZPS | 0.0015 | 0.007 | — | — | — | 0.0015 | — |
| Brighteners | 0.2 | 0.04 | 0.15 | — | — | 0.2 | 0.03 |
| Colored Glassy Phosphate Speckles | 0.1 | 0.5 | 5.0 | 3.5 | 0.5 | 3.5 | 8.0 |
| Moisture + spray-on perfume | 6.0 | 5.6 | 8.9 | 6.0 | 5.9 | 6.0 | 6.0 |
| Titanium Dioxide coated with Mica | .01 | 1.0 | | | | 0.5 | .05 |
| Sulfate | balance | balance | balance | balance | balance | balance | balance |

Example 8
Non-Aqueous Liquid Detergent Composition

| ingredient | % |
|---|---|
| NaLAS | 16.00% |
| Neodol 23-5 | 21.50% |
| BPP | 18.50% |
| Na3citrate | 6.00% |
| Na2CO3 | 12.50% |
| NaEDDS | 1.20% |
| PB1 | 12.00% |
| bleach activator | 6.00% |
| Sokalan CP5 (92%) | 1.25% |
| polymer A | 1.30% |
| speckle | 0.40% |
| protease | 0.80% |
| amylase | 0.80% |
| cellulase | 0.03% |
| perfume | 1.25% |
| TiO2 | 0.50% |
| brightener | 0.20% |
| suds suppressor | 0.06% |
| Colored Glassy Phosphate Speckles | 0.50% |
| misc. | balance |

What is claimed is:

1. A speckled detergent composition comprising:

a) from about 92% to about 99.99%, of conventional laundry ingredients selected from the group consisting of surfactants, builders, chelants, brighteners, bleaching agents, photobleaches, enzymes, soil release polymers, dye transfer inhibitors, fillers, perfumes and mixtures thereof; and b) from about 0.01% by weight to about 8.0% by weight of a glassy phosphate particle colored with a dye and/or pigment wherein said dye and/or pigment is adsorbed onto the glassy phosphate particle by atomizing said dye and/or said pigment onto glassy phospate particle or wherein a blend of water and a non-polar solvent are used to carry said dye and/or pigment such that said glassy phosphate particle is dried by evaporation of said non-polar solvent at a temperature between 25° C. and 100° C.

2. A speckled detergent composition according to claim 1, wherein the composition comprises:

a) from about 95% to about 99.9% by weight of conventional laundry ingredients and;

b) from about 0.1% to about 5% by weight of glassy phosphate.

3. A speckled detergent composition according to claim 1 wherein the composition comprises:

a) from about 96.5% to about 99.5% by weight of conventional laundry ingredients and;

b) from about 0.5% to about 3.5% by weight of glassy phosphate.

4. A speckled detergent composition according to claim 1 wherein the glassy phosphate has the formula: $M_2O:P_2O_5$, wherein M is an alkali metal, and the molar ratio between both oxides is from about 0.7:1 to about 1.3:1.

5. A speckled detergent composition according to claim 2 wherein the glassy phosphate is sodium hexamethaphosphate of average chain length of from 6 to 1000.

6. A speckled detergent composition according to claim 1 wherein from about 0.01% to about 2.0% by weight of the glassy phosphate, of dye or pigment is adsorbed onto the glassy phosphate particle.

7. A speckled detergent composition according to claim 1 wherein the dye is selected from the group consisting of pigments, polymeric colorants, hydrophilic dyes, metal phtalocyanines, complexes of metal phthalocyanines and mixtures thereof.

8. A speckled detergent composition according to claim 1 wherein the dye is selected from zinc phtalocyanine or aluminum phtalocyanine.

9. A speckled detergent composition according to claim 1 wherein the pigment is titanium dioxide coated with mica.

* * * * *